United States Patent [19]

Scotchmer et al.

[11] 4,064,306

[45] Dec. 20, 1977

[54] SUBSTANTIALLY CLOSED FABRIC MADE BY COMPRESSIVE REDISTRIBUTION OF THE FILAMENTS OF AT LEAST SOME YARNS OF AN OPEN MESH FABRIC

[75] Inventors: Stephen R. Scotchmer, St. Catharines; Robert D. MacGregor, Hazeldean, both of Canada

[73] Assignee: Bay Mills Limited, Downsview, Canada

[21] Appl. No.: 761,723

[22] Filed: Jan. 24, 1977

Related U.S. Application Data

[63] Continuation of Ser. No. 650,960, Jan. 19, 1976, abandoned, which is a continuation of Ser. No. 466,492, May 2, 1974, abandoned.

[51] Int. Cl.[2] ..... B32B 5/26; B32B 31/20; D03D 13/00; D04H 3/12; D04H 3/14

[52] U.S. Cl. ..... 428/255; 156/181; 156/296; 156/306; 427/375; 428/288; 428/295; 428/296; 428/302

[58] Field of Search ..... 428/295, 296, 302, 288, 428/255, 196; 427/375; 156/181, 296, 306; 28/73

[56] References Cited

U.S. PATENT DOCUMENTS

| | | | |
|---|---|---|---|
| 2,521,055 | 9/1950 | Foster | 156/181 |
| 2,537,323 | 1/1950 | Wurgburger | 428/296 |
| 2,711,828 | 6/1955 | Webb et al. | 156/306 |
| 2,757,435 | 8/1956 | Bihaly | 28/73 |
| 2,769,222 | 11/1956 | Southwell | 28/73 |
| 2,864,151 | 12/1958 | Bihaly | 428/296 |
| 3,445,055 | 5/1969 | Port et al. | 156/181 |
| 3,479,244 | 11/1969 | Burnett | 428/296 |
| 3,579,409 | 5/1971 | Shannon | 428/255 |
| 3,930,091 | 12/1975 | Lewis et al. | 156/181 |
| 3,949,111 | 4/1976 | Pelletier | 428/288 |

*Primary Examiner*—J.C. Cannon
*Attorney, Agent, or Firm*—Sim & McBurney

[57] ABSTRACT

A substantially closed fabric with a soft hand is made by compressive redistribution of the filaments of at least some of the yarns of an open mesh fabric. In order to achieve the desired result, certain characteristics of the yarn and the fabric are necessary and are disclosed, e.g., continuous filament yarns having not more than one turn per inch, a fabric having a denier per inch of at least four thousand and a thermoplastic coating with a softening point less than that of the filaments. The thermoplastic coating is resoftened to the point where the filaments are capable of being spread apart. Compressive pressure then is applied to achieve this result. The redistributed yarns then are held in their new position until the thermoplastic coating has set to at least the point where it is capable of holding the filaments.

25 Claims, 7 Drawing Figures

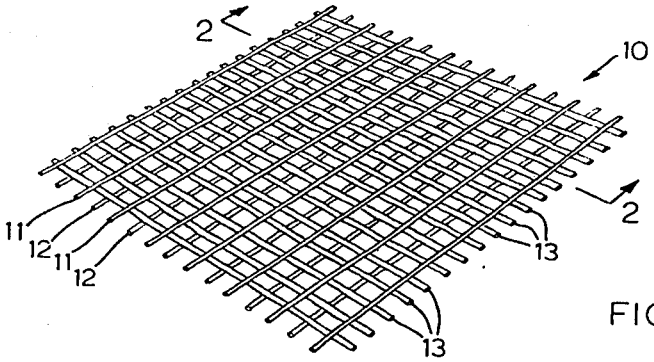
FIG. 1
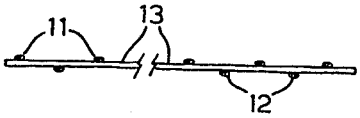
FIG. 2
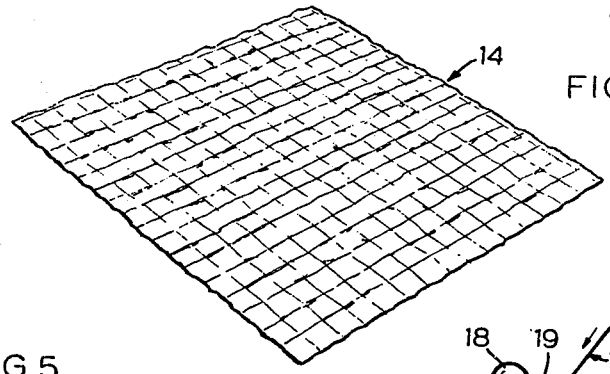
FIG. 3
FIG. 5
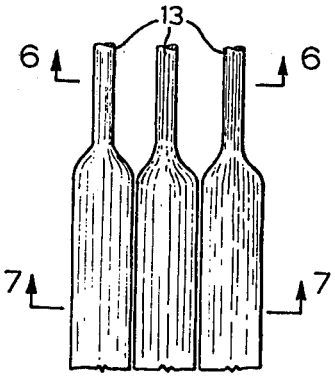
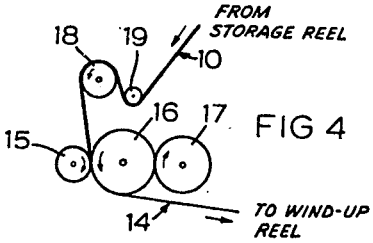
FIG 4
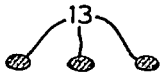
FIG 6
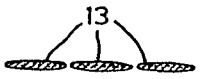
FIG 7

SUBSTANTIALLY CLOSED FABRIC MADE BY COMPRESSIVE REDISTRIBUTION OF THE FILAMENTS OF AT LEAST SOME YARNS OF AN OPEN MESH FABRIC

This application is a continuation of application Ser. No. 650,960 filed Jan. 19, 1976 and now abandoned, which, in turn, was a continuation of application Ser. No. 466,492 filed May 2nd, 1974 (now abandoned).

This invention relates to essentially closed fabrics that can be manufactured by compressive redistribution of the filaments of at least some of the yarns of an open mesh fabric. This invention also relates to methods for making such closed fabrics.

As is well known in the art, an open mesh fabric is one in which adjacent warp yarns are spaced apart from each other and adjacent fill yarns also are spaced apart from each other, whereby there are a multiplicity of openings in the fabric. A typical open mesh scrim fabric is shown in Canadian Pat. No. 882,081 issued Sept. 28, 1971, for example. Such a fabric, which is one that is not made in the conventional manner on a loom, but which consists of at least two layers of yarns laid one on top of the other, may be used as the starting fabric in the practise of this invention. However, it also is possible to use a conventionally woven fabric as the starting fabric.

A closed fabric, on the other hand, is one in which either the warp or fill yarns or both are disposed side-by-side so that there are substantially no openings, or only very small openings, in the fabric.

A closed, scrim fabric can be made, for example, by laying fill yarns side-by-side, laying warp yarns side-by-side over or under or both over and under the fill yarns generally at right angles thereto, and uniting the warp and fill yarns with a suitable adhesive. The problem with such a closed, scrim fabric is that it does not have a soft hand and employs a large number of yarns.

There are many applications, for example, upholstery and carpet backing, where a closed fabric having a soft hand may be desirable. Also the fabric may be used for reinforcing vinyl without show through.

In accordance with this invention there is provided a closed fabric having a soft hand and a new process for making the same. Briefly, a substantially closed fabric is made by compressive redistribution of the filaments of at least some of the yarns of an open mesh fabric. The latter has at least one layer of warp and at least one layer of fill yarns, the warp and fill yarns being laid to intersect each other. The yarns of at least one of the groups are composed of continuous filaments having at least twenty filaments per yarn, and these yarns also have not more than one turn per inch. The denier per inch of this group is at least four thousand. The yarns are coated with a thermoplastic material having a softening point less than that of the filaments. The yarns of the closed fabric lie in substantially a single layer with at least the aforesaid filaments spread out and, together with the yarns of the other group, which may or may not be spread out, occupying the previously open area of the open mesh fabric.

In order to make such a closed fabric, the following steps are employed. The thermoplastic material is preheated to its softening point so that the filaments, which previously have been held together in a close bundle by the thermoplastic material, are capable of being spread out. Compressive pressure then is applied to the open mesh fabric to spread out and redistribute the filaments, at the same time reducing the thickness of the fabric. The filaments then are held in their redistributed position in contact with a cool surface and while under tension at least until the thermoplastic material has set sufficiently so that it can hold the filaments in their redistributed position. After this the resultant closed fabric may be further cooled to prevent blocking and then wound on a reel.

This invention will become more apparent from the following detailed description, taken in conjunction with the appended drawings, in which:

FIG. 1 is a perspective view of an open mesh, scrim fabric which is one of the fabrics that may be used as a starting fabric in the practice of this invention, FIG. 2 is a section taken along line 2—2 in FIG. 1, FIG. 3 is a perspective view of a closed fabric embodying this invention and which has been made from the fabric shown in FIG. 1, FIG. 4 is a schematic side view of equipment that may be used in making the fabric shown in FIG. 3, FIG. 5 is a top elevation showing how the filaments of the fabric are redistributed under compressive pressure, FIG. 6 is a section taken along line 6—6 in FIG. 5, and FIG. 7 is a section taken along line 7—7 in FIG. 5.

Referring to FIG. 1, the open mesh, scrim fabric 10 shown therein is composed of warp yarns 11 and 12 and fill yarns 13. Fill yarns 13 are laid parallel to each other and are substantially equally spaced. Warp yarns 11 are laid on top of the fill yarns, also substantially parallel to each other, substantially equally spaced and at right angles to the fill yarns. Warp yarns 12 are laid below the fill yarns and also are substantially parallel to each other, substantially equally spaced and at right angles to the fill yarns. It is not essential, however, in order to make the closed fabric 14 shown in FIG. 3, for the yarns of the various layers to be parallel and equally spaced, nor is it essential that the yarns of adjacent layers intersect at right angles. These all are criteria that preferably are met by the starting fabric, but those skilled in the art will understand, as this description proceeds, that these preferred criteria may be departed from. As best shown in FIG. 2, warp yarns 12 are located midway between adjacent warp yarns 11. Furthermore, the spacing between adjacent warp yarns 11 and 12 is the same as the spacing between adjacent fill yarns 13. Again these are preferred but not essential criteria, and it is to be understood that a fabric embodying this invention can be made from fabrics other than fabric 10. In fact, a fabric embodying this invention can be made from a fabric devoid of warp yarns 12 or devoid of warp yarns 11 as long as there are some warp yarns, which may be on either or both sides of the fill yarns, to serve the function, when coated with an adhesive, of holding the fill yarns in place. Alternatively, the fill yarns may serve the function of holding the warp yarns in place.

The warp and fill yarns are coated with a thermoplastic coating that serves to hold the yarns in place with respect to each other and also holds the filaments of the yarns in place.

Fabric 10 may be made in a number of known ways. Reference may be made to the aforementioned patent for one process for making fabric 10.

Closed fabric 14 embodying this invention and shown in FIG. 3 is made by compressive redistribution of the filaments of the yarns of fabric 10. The result of the compressive redistribution operation, which will be discussed in greater detail hereafter, is to flatten out yarns 11–13 so that substantially all of the openings defined by yarns 11–13 in fabric 10 become filled with the filaments that make up yarns 11–13. The result is a closed fabric having a soft hand when compared with the hand of the starting fabric. In contrast to fabric 10 where yarns 11–13 lie in three distinct layers, the yarns in fabric 14 have been compressed so that they all lie in essentially a single layer.

In order to achieve the desired result, it has been discovered that fabric 10 must have certain characteristics which now will be outlined.

Dealing first with the yarns, the desired result can be achieved if only one layer of the yarns is compressed sufficiently to close the interstices in fabric 10. In this case the other layer of yarns serves merely to hold the firstmentioned yarns in position, and while this other layer of yarns also will be compressed, the compression thereof adds little to the filling of the interstices. Thus, as least one of the layers of yarns, namely the one that will be primarily responsible for spreading out to fill the interstices, must be made of yarns that are fabricated of continuous filaments. Preferred filaments are rayon, nylon, polyester, polypropylene and glass. The aforesaid yarns also must be multi-filament yarns with at least twenty filaments per yarn. The aforesaid yarns preferably should be heat set so that they will not shrink during the compressive redistribution otherwise puckers may result in fabric 14. The aforesaid yarns preferably should contain zero turns per inch but, in any event, should have not more than one turn per inch. It also is preferred for the denier per yarn to be 200 or more.

Preferably all of the yarns in fabric 10, or in another open mesh fabric that might be substituted for fabric 10, should have the above characteristics, and such is the case with yarns 11–13. However, if fabric 10 were constructed of only warp yarns 11 and fill yarns 13, and reliance was being placed only on the warp yarns, for example, to spread out and fill the interstices, only the warp need have these characteristics. In this case the fill yarns would function merely to hold the warp yarns in position. They could be spaced as widely apart as performing this function would permit and generally could be constructed in any way and from any type of material as long as the material was one which was compatible with the other materials used in the fabric and as long as the fill yarns were strong enough to perform their required function. It is decidedly preferred, however, for all of the yarns to have the aforesaid characteristics, since this means that fabric 14 will be more homogeneous.

The fabric 10 also must possess certain characteristics in order for the desired result to be achieved. More specifically, the denier per inch of the yarns that extend in substantially the same direction and which spread out under compressive redistribution to fill the interstices must be at least 4000. Consequently, this criteria would not apply to the fill yarns in the above example where reliance is placed only on the warp yarns to spread out and fill the interstices, although it would apply to the warp yarns. In the case of fabric 10, this requirement is met by warp yarns 11 and 12 taken together and also by fill yarns 13. It is decidedly preferable for this requirement to be met by both the warp and the fill yarns to obtain a homogeneous product, and preferably the denier per inch of the warp and fill yarns should be substantially the same for the same reason. For the same reason it is desirable for the denier per yarn of the warp yarns to be substantially the same as the denier per yarn of the fill yarns. In fabric 10 the denier per yarn of warp yarns 11, and 13 is the same. In addition, the number of fill yarns per inch is the same as the total number of warp yarns per inch. If fabric 10 were constructed only of warp yarns 11 and fill yarns 13, both yarns preferably would have the same denier per yarn.

In order for the desired results to be obtained, the open area of the fabric from which fabric 14 is made should be not more than 70% of the area of the fabric. The open area of closed fabric 14 preferably should be about 0%, depending on the use to which the fabric is to be put, but, in any event, the open area should be reduced by at least 50%. Thus, where we refer herein to a substantially closed fabric, what is meant is a fabric having an open area that is not more than 35% of the area of the fabric.

The nature of the thermoplastic coating also is important. It must have a softening point which is lower than that of the filaments of the yarns that are spread out during compressive redistribution to fill the interstices. Examples are polyvinylchloride, polyvinylacetate and low softening point polyesters. When polyester filaments are employed along with a thermoplastic coating which also is a polyester, the latter would have to have a lower softening point than that of the polyester filaments.

The amount of coating that should be employed varies depending upon the yarn and the type of coating. The minimum amount of thermoplastic coating will be about 5% based on the weight of the coated yarn. The preferred amount will be of the order of 50%. Amounts considerably in excess thereof can be employed, however, it being understood that in such cases the hand of fabric 14 will harden. The thermoplastic coating serves the function, in fabric 10, of bonding yarns 11–13 together. In fabric 14 the coating keeps the filaments of the yarns in place after they have been spread out by compressive redistribution.

Reference now will be made to FIG. 4 for a description of how fabric 14 is made from fabric 10. Shown in FIG. 4 are three rotatable rolls 15, 16 and 17. The rolls are rotatably mounted with roll 15 being mounted in bearings (not shown) that are slidable in the frame (not shown) that supports the rolls and which can be driven to vary the pressure between the rolls. A suitable motor (not shown) and gearing is provided for driving the rolls in the directions indicated. An auxiliary roll 18 rotatably mounted on an axis parallel to the axes of rotation of rolls 15–17 also is provided together with an idler roll 19.

Roll 18 is heated to preheat fabric 10 that is unwound from a storage reel (not shown). The effect of the preheating is to soften the thermosplastic coating to the point where the filaments of the yarns can be spread out. Roll 15 also is heated to a temperature such that the thermoplastic coating remains soft. As fabric 10 passes between rolls 15 and 16, compressive redistribution of the filaments of the yarns takes place. This is best shown in FIGS. 5–7 where, for the sake of simplicity, only fill yarns 13 are shown. As these yarns pass between rolls 15 and 16, the filaments thereof, which prior to this passage were parallel to each other, spread out, while remaining parallel to each other, to occupy the spaces that previously existed between the yarns and, or course, the thickness of the yarns diminishes considerably.

An important feature of this aspect of the invention is that after the filaments have been spread out as shown in FIG. 5, they are maintained, while in tension, in contact with a cool surface for a period of time sufficient for the thermoplastic coating to harden to a point where the filaments cannot revert to their original positions. This is achieved by maintaining contact between fabric 14 and roll 16 after the fabric has passed between rolls 15 and 16, as shown in FIG. 4. It has been discovered that if this technique is not practised and the fabric is taken directly away from the rolls after passage between rolls 15 and 16, the filaments tend to revert to their original positions resulting in an open mesh fabric. The fabric 14, is stripped from roll 16 after the thermoplastic coating has set sufficiently and then may be further cooled to room temperature to prevent blocking before being taken up on a wind-up reel (not shown).

Referring to FIG. 4, roll 17 is employed simply for the purpose of keeping roll 16 cool. Roll 17 may be a steel roll and may be water cooled, for example, to maintain roll 16, which preferably is a cotton roll, at a surface temperature below the softening point of the thermoplastic coating. Roll 15 may be a steel roll and, like roll 18, may be steam, electrically or otherwise heated. The speed of the fabric may vary widely. However, at higher speeds greater difficulty in preheating the fabric may be experienced.

In a specific example of the process of fabric 10 of the type shown in FIG. 1 and having the following characteristics was used: 7½ polyester yarns per inch in both the warp and fill directions, each yarn being of 1000 denier and composed of 192 filaments, each yarn having 0.035 turns per inch, open mesh fabric, polyvinylchloride coating (53% by weight of the coated fabric), fabric 48% open.

Rolls 15–17 were of the following diameters: 6, inches 9.9 inches and 9 inches respectively. The fabric was preheated to 260° F. Roll 15 was heated to 360° F, and roll 16 was maintained at about 160° F. A pressure of 525 lbs./lineal in. was applied between rolls 15 and 16. The fabric speed was 18 feet/minute.

After fabric 10 had been passed through the apparatus, it was found that all of the yarns had spread out to occupy the interstices. The open area of the fabric was reduced by 96% and its thickness by 56%. It possessed a soft hand.

It is important to realized that the closed nature of fabric 14 is not accomplished by the thermoplastic coating flowing into and occupying the spaces between the yarns. There is a flow of the thermoplastic coating, of course, but the filling in of the interstices is accomplished by a spreading out and flattening of the yarns. Where "off-the-shelf" yarns are employed, the compressive redistribution operation will reduce the fabric thickness by at least 30%.

While preferred embodiments of the invention have been described herein in detail, those skilled in the art will appreciate that changes and modifications may be made without departing from the spirit and scope of the claims appended hereto.

We claim:

1. A process for making an essentially closed fabric which comprises: providing an open mesh fabric having an open area of less than 70% of the area of the fabric, the open mesh fabric being of a type comprising at least one layer of warp yarns and at least one layer of fill yarns, said at least one layer of warp yarns constituting one group of yarns, said at least one layer of fill yarns constituting a second group of yarns, said warp and fill yarns intersecting one another at an angle, at least the yarns of one of said two groups of yarns being composed of continuous filaments having at least twenty filaments per yarn, at least said yarns of said one group also having not more than one turn per inch, the denier per inch of at least said one group of yarns being at least four thousand, said yarns being coated with at least 5% based on the weight of the yarns after having been coated of a thermoplastic material having a softening point which is lower than the softening point of said filaments, said thermoplastic material being in a sufficiently soft condition that said filaments are capable of spreading out when subjected to compression; applying sufficient pressure to said open mesh fabric to cause said filaments to spread out to close the openings in said open mesh fabric to the extent that the open area of said open mesh fabric is reduced by at least 50% with all of said yarns lying in substantially a single layer, said pressure being applied by passing said open mesh fabric through the nip between two rotating rolls, one of said rolls being heated to a surface temperature at said nip above said softening point of said thermoplastic material but less than the softening point of said filaments and the other of said rolls having a surface temperature less than the softening point of said thermoplastic material; and maintaining said filaments in their spread out position while permitting said thermoplastic material to set by withdrawing the fabric from said nip while maintaining said fabric in tension and in contact with the surface of said other roll immediately after said fabric has passed through said nip for a time at least sufficient for said thermoplastic material to set to a point where it maintains said filaments in spread out position, whereby an essentially closed fabric is made by compressively redistributing said filaments of at least said one group of yarns of said open mesh fabric.

2. A process according to claim 1 wherein said soft condition of said thermoplastic material is achieved by preheating said open mesh fabric to at least the softening point of said thermoplastic material but to less than the softening point of said filaments, said open mesh fabric in preheated condition being passed through the nip between said rotating rolls.

3. A process according to claim 2 wherein the difference in thickness between said open mesh fabric entering said nip and said substantially closed fabric leaving said nip is at least 30%.

4. The product produced by the process of claim 1.

5. The product produced by the process of claim 2.

6. The product produced by the process of claim 3.

7. The product produced by the process of claim 1 and wherein in said open mesh fabric said yarns of said one group in any layer thereof are substantially parallel to each other and substantially equally spaced.

8. The product produced by the process of claim 1 and wherein the denier per yarn of at least said yarns of said one group is at least 200.

9. The product produced by the process of claim 1 and wherein all of said yarns are composed of continuous filaments having at least twenty filaments per yarn, all of said yarns have not more than one turn per inch and a denier of at least 200 and the denier per inch of both the warp and fill yarns is at least 4,000.

10. The product produced by the process of claim 1 and wherein said warp and fill yarns intersect one another at about right angles.

11. The product produced by the process of claim 1 and wherein in said open mesh fabric there are two layers of warp yarns and one layer of fill yarns, said fill yarns being between said layers of warp yarns.

12. The product produced by the process of claim 1 and wherein said filaments are selected from the group consisting of rayon, nylon, polyester, polypropylene and glass.

13. The product produced by the process of claim 1 and wherein said yarns of said one group have zero turns per inch.

14. The product produced by the process of claim 1 and wherein said thermoplastic material is selected from the group consisting of polyvinylchloride, polyvinylacetate and polyesters.

15. The product produced by the process of claim 1 and wherein the weight of said thermoplastic material is about 50%.

16. The product produced by the process of claim 1 and wherein the thickness of said substantially closed fabric is at least 30% less than the thickness of said open mesh fabric.

17. The product produced by the process of claim 1 and wherein said open mesh fabric comprises at least two layers of yarn laid one on top of the other.

18. The product produced by the process of claim 1 and wherein said open mesh fabric comprises at least two layers of yarn laid one on top of the other, in said open mesh fabric said yarns of said one group in any layer thereof being substantially parallel to each other and substantially equally spaced.

19. The product produced by the process of claim 1 and wherein said open mesh fabric comprises at least two layers of yarn laid one on top of the other, the denier per yarn of at least said yarns of said one group being at least 200.

20. The product produced by the process of claim 1 and wherein said open mesh fabric comprises at least two layers of yarn laid one on top of the other, the denier per yarn of at least said yarns of said one group being least 200, all of said yarns being composed of continuous filaments having at least 20 filaments per yarn, all of said yarns having not more than one turn per inch at a denier of at least 200 and the denier per inch of both the warp and the fill yarns being at least 4,000.

21. The product produced by the process of claim 1 and wherein said open mesh fabric comprises at least two layers of yarn laid one on top of the other, the denier per yarn of at least said yarns of said one group being at least 200, all of said yarns being composed of continuous filaments having at least 20 filaments per yarn, all of said yarns having not more than one turn per inch at a denier of at least 200 and the denier per inch of both the warp and the fill yarns being at least 4,000, in said open mesh fabric the yarns of each group in any layer thereof being substantially parallel to each other and substantially equally spaced.

22. The product produced by the process of claim 1 and wherein said open mesh fabric comprises at least two layers of yarn laid one on top of the other, the denier per yarn of at least said yarns of said one group being at least 200, all of said yarns being composed of continuous filaments having at least 20 filaments per yarn, all of said yarns having not more than one turn per inch at a denier of at least 200 and the denier per inch of both the warp and the fill yarns being at least 4,000, in said open mesh fabric the yarns of each group in any layer thereof being substantially parallel to each other and substantially equally spaced, the thickness of said substantially closed fabric being at least 30% less than the thickness of said open mesh fabric.

23. The product produced by the process of claim 1 and wherein said open mesh fabric comprises at least two layers of yarn laid one on top of the other, the denier per yarn of at least said yarns of said one group being at least 200, all of said yarns being composed of continuous filaments having at least 20 filaments per yarn, all of said yarns having not more than one turn per inch at a denier of at least 200 and the denier per inch of both the warp and the fill yarns being at least 4,000, in said open mesh fabric the yarns of each group in any layer thereof being substantially parallel to each other and substantially equally spaced, the thickness of said substantially closed fabric being at least 30% less than the thickness of said open mesh fabric, said warp yarns all having the same number of filaments per yarn, said fill yarns all having the same number of filaments per yarn, the number of filaments per inch of the warp and fill yarns being the same and the denier per inch of the warp and fill yarns being the same.

24. The product produced by the process of claim 1 and wherein said open mesh fabric comprises at least two layers of yarn laid one on top of the other, the denier per yarn of at least said yarns of said one group being at least 200, all of said yarns being composed of continuous filaments having at least 20 filaments per yarn, all of said yarns having not more than one turn per inch at a denier of at least 200 and the denier per inch of both the warp and the fill yarns being at least 4,000, in said open mesh fabric the yarns of each group in any layer thereof being substantially parallel to each other and substantially equally spaced, the thickness of said substantially closed fabric being at least 30% less than the thickness of said open mesh fabric, said warp yarns all having the same number of filaments per yarn, said fill yarns all having the same number of filaments per yarn, the number of filaments per inch of the warp and fill yarns being the same and the denier per inch of the warp and fill yarns being the same, there being two layers of warp yarns and one layer of fill yarns, said fill yarns being between said layers of warp yarns.

25. The product produced by the process of claim 1 and wherein said open mesh fabric comprises at least two layers of yarn laid one on top of the other, the denier per yarn of at least said yarns of said one group being at least 200, all of said yarns being composed of continuous filaments having at least 20 filaments per yarn, all of said yarns having not more than one turn per inch at a denier of at least 200 and the denier per inch of both the warp and the fill yarns being at least 4,000, in said open mesh fabric the yarns of each group in any layer thereof being substantially parallel to each other and substantially equally spaced, the thickness of said substantially closed fabric being at least 30% less than the thickness of said open mesh fabric, said warp yarns all having the same number of filaments per yarn, said fill yarns all having the same number of filaments per yarn, the number of filaments per inch of the warp and fill yarns being the same and the denier per inch of the warp and fill yarns being the same, there being two layers of warp yarns and one layer of fill yarns, said fill yarns being between said layers of warp yarns, said warp and fill yarns intersecting one another at about right angles.

* * * * *